US011248889B1

(12) United States Patent
Van Der Eerden

(10) Patent No.: US 11,248,889 B1
(45) Date of Patent: Feb. 15, 2022

(54) CHOKED SHOTGUN SHELL

(71) Applicant: Eric Van Der Eerden, North Vancouver (CA)

(72) Inventor: Eric Van Der Eerden, North Vancouver (CA)

( * ) Notice: Subject to any disclaimer, the term of this patent is extended or adjusted under 35 U.S.C. 154(b) by 0 days.

(21) Appl. No.: 16/576,954

(22) Filed: Sep. 20, 2019

(51) Int. Cl.
*F42B 7/06* (2006.01)
*F42B 7/08* (2006.01)
*F42B 7/04* (2006.01)

(52) U.S. Cl.
CPC ..... *F42B 7/06* (2013.01); *F42B 7/046* (2013.01); *F42B 7/08* (2013.01)

(58) Field of Classification Search
CPC ..... F42B 7/00; F42B 7/02; F42B 7/04; F42B 7/06; F42B 7/046; F42B 7/08; F41A 21/40
See application file for complete search history.

(56) References Cited

U.S. PATENT DOCUMENTS 1,864,916 A 6/1932 Gachassin-Lafite
3,121,391 A * 2/1964 Young ..... F42B 7/04 102/454
3,146,713 A * 9/1964 Sawyer ..... F42B 7/08 102/448
3,974,775 A 8/1976 Kerzman et al.
4,295,426 A 10/1981 Genco et al.
5,413,050 A * 5/1995 Maki ..... F42B 7/04 102/449
5,644,100 A 7/1997 Puckett et al.
5,874,689 A 2/1999 Alkhatib et al.
5,970,878 A 10/1999 Gardner
6,260,484 B1 7/2001 Billings
7,243,603 B2 * 7/2007 Sheaffer ..... F42B 7/043 102/449
7,415,929 B1 * 8/2008 Faughn ..... F42B 7/08 102/448
9,879,957 B2 1/2018 Moser et al.
2005/0056184 A1 * 3/2005 Dunnam ..... F42B 12/38 102/458
2007/0012212 A1 * 1/2007 Sheaffer ..... F42B 7/043 102/457
2015/0176954 A1 6/2015 Burczynski et al.
2019/0093997 A1 * 3/2019 Billings ..... F42B 7/08

* cited by examiner

*Primary Examiner* — Benjamin P Lee
(74) *Attorney, Agent, or Firm* — Cramer Patent & Design, PLLC; Aaron R. Cramer

(57) ABSTRACT

A shotgun shell incorporates a traditionally-configured shotgun shell and housing having a choke secured within the shell between the pellets and the charge.

1 Claim, 5 Drawing Sheets

CHOKED SHOTGUN SHELL

RELATED APPLICATIONS

None.

FIELD OF THE INVENTION

The present invention relates generally to shotgun shells. Specifically, to a choked shotgun shell.

BACKGROUND OF THE INVENTION

The shotgun is a formidable weapon capable of many different roles. It can be used for hunting, self-defense, and sporting use. It is also used by law enforcement and military where it excels at tasks that other weapons perform poorly. Many shotgun users rely on guns with barrels of different interior patterns to produce tight or wide dispersions of the pellets. Ones with narrow dispersions are called "choked".

However, the ability to change dispersions during shooting requires the use of at least two different guns or perhaps the use of a double barrel shotgun. Accordingly, there exists a need for a means by which a dispersion pattern for shotguns can be determined by the cartridge (shell) rather than the shotgun itself in order to address this disadvantage. The development of the choked shotgun shell fulfills this need.

SUMMARY OF THE INVENTION

The principles of the present invention provide for a shotgun shell, comprises a base having a contained charge and a primer, a wad having a shorter length than a conventional shotgun shell, a plastic case having a longer length than the conventional shotgun shell and a plurality of pellets having an equal mass and quantity to the conventional shotgun shell. The pellets are arranged in a longer and thinner configuration as provided for a reduction of size of the wad. The shell also comprises an additional space which is provided within the plastic case occupied by a first inner lining and a second inner lining. The first inner lining and the second inner lining restrict an opening diameter through a crimping at a top of the conventional shotgun shell. The opening diameter presents a smaller opening for which the pellets to exit through the crimping and thus provides a narrower travel path and a tighter grouping of pellets upon a target. The pellets produce a choked pellet distribution that provides a pellet spray path with a choked distribution width and a choked distribution length.

The plastic case may be an outermost layer and may have blue or yellow color to allow for rapid identification of the shotgun shell. The first inner lining may be a next outermost layer while the second inner lining may be a third inner layer. The second inner lining may be thicker than the plastic case and the first inner lining to provide a structurally significant component which contains the pellets during activation of the primer and the charge. The aforementioned containing may aid in throttling the pellets to provide a tighter grouping.

The opening diameter afforded by the second inner lining may produce a pellet travel path which does not allow the pellets to contact an interior surface of the barrel and thus produces a pellet void area which produces the narrow grouping. The shotgun shell may produce a choked pellet distribution that is thinner but longer that a normal pellet distribution produced by a conventional shotgun shell. The shotgun shell may produce a concentrated pellet spray pattern with a choked dispersion pattern. The shotgun shell may be utilized with all types of shotguns or specifically limited to a bolt-action shotgun or a pump-action shotgun.

The shotgun shell may be utilized with a break action shotgun or a single barrel break action shotgun or a double barrel break action shotgun.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
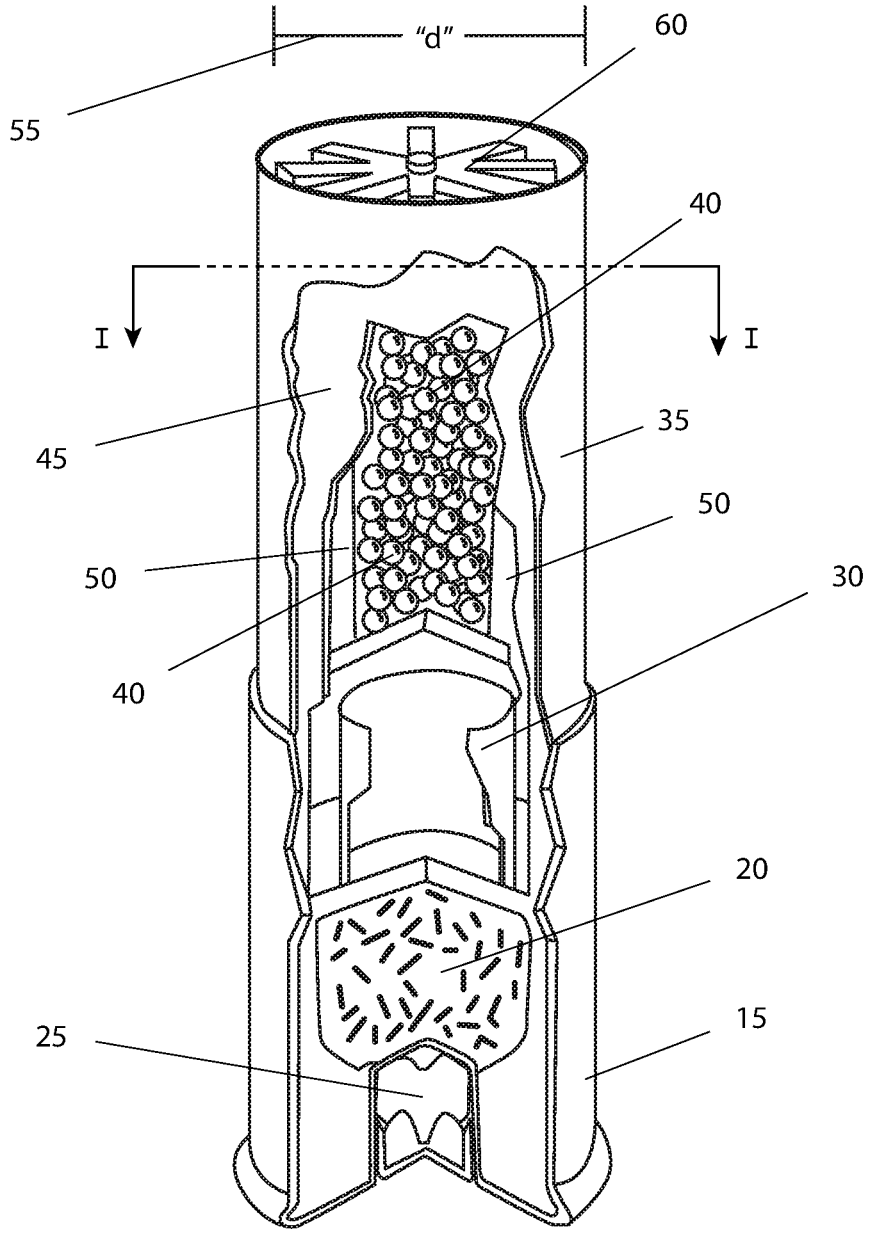
FIG. 1 is a cutaway side view of the shotgun shell 10, according to the preferred embodiment of the present invention.

10 shotgun shell
15 base
20 charge
25 primer
30 wad
35 plastic case
40 pellets
45 first inner lining
50 second inner lining
55 opening diameter "d"
60 crimping
65 shotgun
70 barrel
75 receiver
80 pellet travel path "p"
85 pellet void area
90 normal pellet distribution
95 normal distribution width "nw"
100 normal distribution length "nl"
105 choked pellet distribution
110 choked distribution width "cw"
115 choked distribution length "cl"
120 target
125 dispersed pellet spray pattern
130 concentrated pellet spray pattern

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) configuration shall be shown and described for purposes of clarity and disclosure and not by way of limitation of scope. All the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a cutaway side view of the shotgun shell 10, according to the preferred embodiment of the present invention is disclosed. The shotgun shell 10 includes many of the same components as found in a conventional shotgun shell. These components, such as the base 15 and its contained charge 20 and primer 25 remain the same. However, the wad 30 is shorter than a conventional shotgun shell. To make up for this difference, the plastic case 35 is longer. Likewise, the number of pellets 40 are equal in mass and quantity to those found in a conventional shotgun shell, however, are arranged in a longer and thinner configuration as provided for the reduction of size of the wad 30. The additional space provided within the plastic case 35 is occupied by a first inner lining 45 and a second inner lining 50.

The first inner lining 45 and the second inner lining 50 restrict an opening diameter "d" 55 through a crimping 60 as expected at the top of the shotgun shell 99. The reduced opening diameter "d" 55 presents a smaller opening for which the pellets 40 to exit through the crimping 60 and thus provides a narrower travel path and a tighter grouping of pellets upon a target as will be described in greater detail herein below. As the shotgun shell 10 provides an outward appearance significantly like a conventional shotgun shell, it is envisioned that the plastic case 35 would be produced with a different color such as blue or yellow to allow for rapid identification of the shotgun shell 10. However, the specific color of the plastic case 35 is not intended to be a limiting factor of the present invention.

Figure 2:
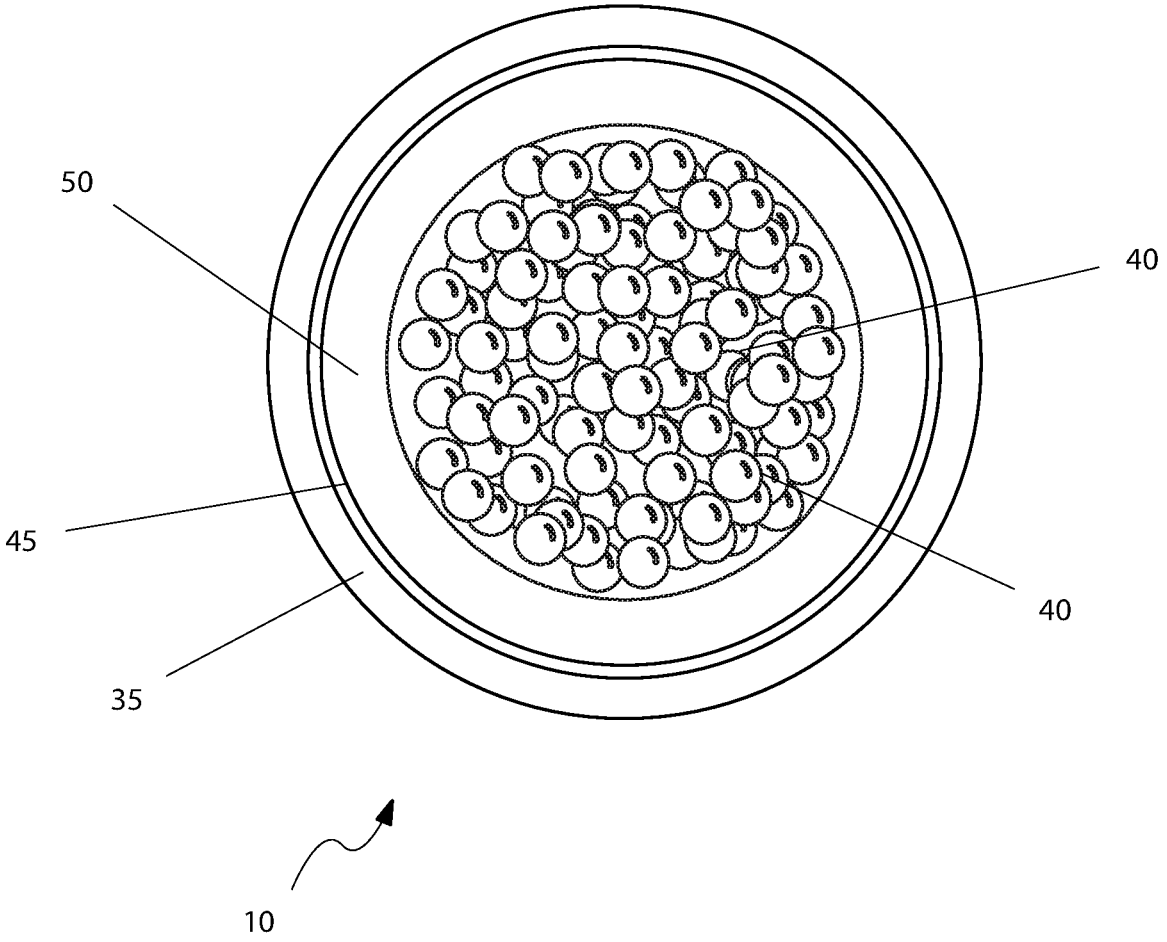
FIG. 2 is a sectional view of the shotgun shell 10, as seen along a line I-I, as shown in FIG. 1, according to the preferred embodiment of the present invention.

Referring next to FIG. 2, a sectional view of the shotgun shell 10, as seen along a line I-I, as shown in FIG. 1, according to the preferred embodiment of the present invention is depicted. The plastic case 35 is shown as the outermost layer as expected. The first inner lining 45 is disclosed as the next outermost layer. The second inner lining 50 is then shown as the third inner layer. It is noted that the second inner lining 50 is of a significant thickness when compared to the plastic case 35 and the first inner lining 45. This thickness provides a structurally significant component which contains the pellets 40 during activation of the primer 25 (as shown in FIG. 1) and the charge 20 (as shown in FIG. 1). The containment aids in the throttling or "choking" of the pellets 40 to provide a narrower or tighter grouping. The narrow grouping will be described in greater detail herein below.

Figure 3:
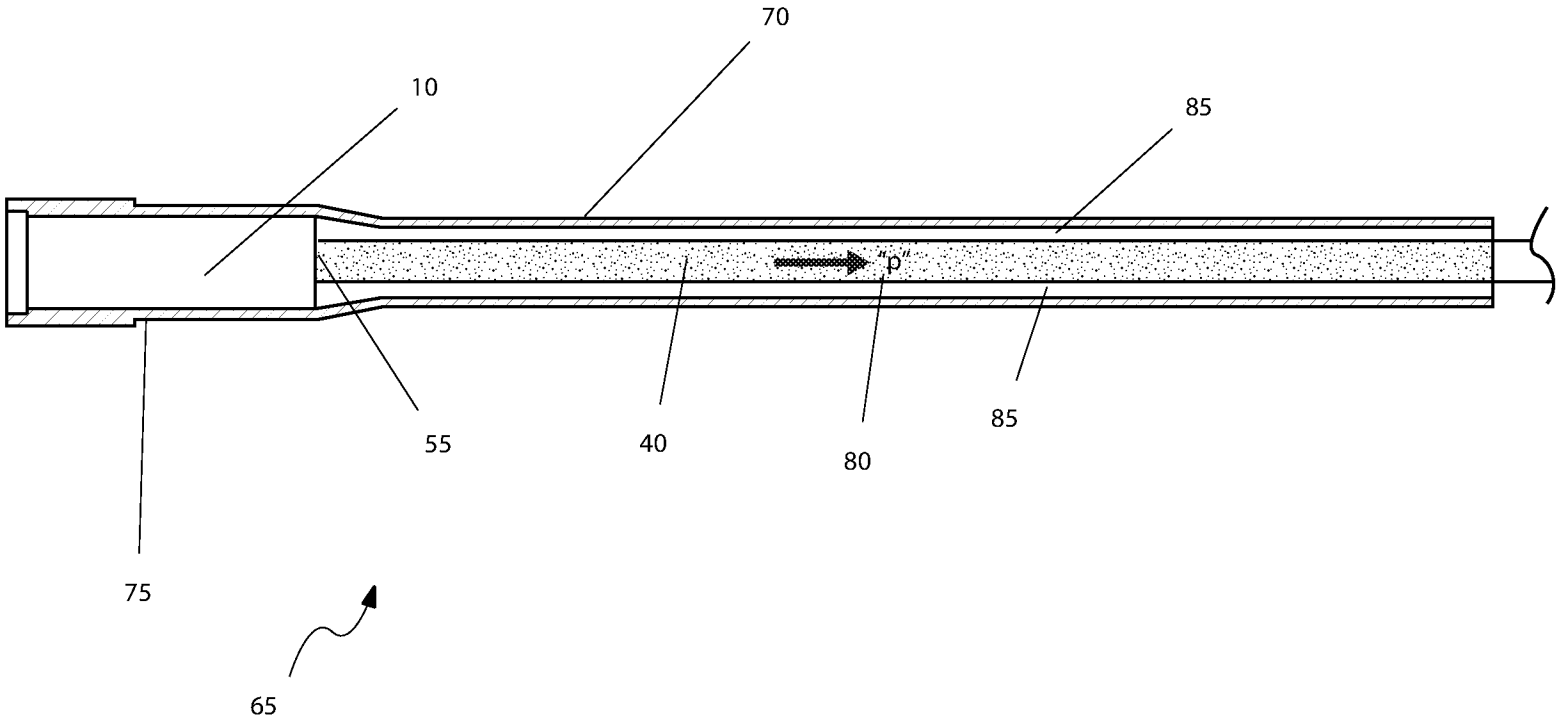
FIG. 3 is a sectional view of a shotgun 65 immediately after firing the shotgun shell 10, according to the preferred embodiment of the present invention.

Referring now to FIG. 3, a sectional view of a shotgun 65 immediately after firing a shotgun shell 10, according to the preferred embodiment of the present invention is shown. Only the barrel 70 and the receiver 75 of the shotgun 65 are shown for clarity. This action displayed is only fractions of a second after the shotgun 65 is fired and thus the pellets 40 are still traveling within the barrel 70. The opening diameter "d" 55 as afforded by the second inner lining 50 (as shown in FIG. 1 and FIG. 2) produces a pellet travel path "p" 80 which does not allow the pellets 40 to contact the interior surface of the barrel 70 and thus produces a pellet void area 85 which produces a narrow or "choked" grouping as will be described in greater detail herein below.

Figure 4:
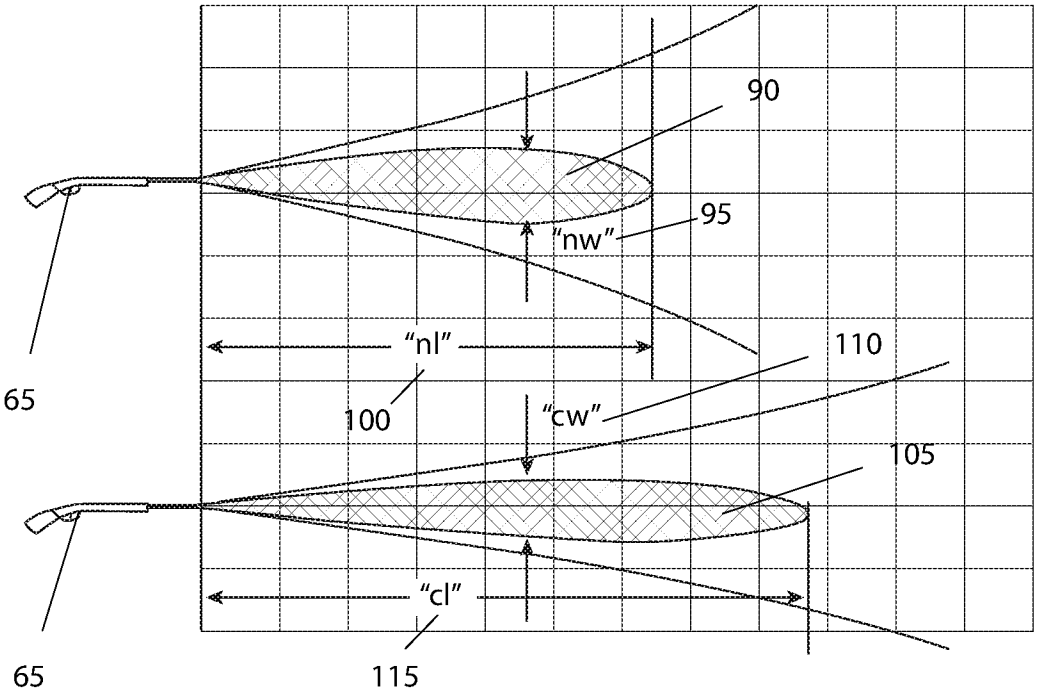
FIG. 4 is a diagram depicting a choked pellet distribution 105 resulting from firing the shotgun shell 10 versus a conventional shotgun shell from the same shotgun 65, according to the preferred embodiment of the present invention; and, FIG. 5 is a diagram depicting the normal pellet distribution 90 resulting from firing the shotgun shell 10 versus a conventional shotgun shell from the same shotgun 65, according to the preferred embodiment of the present invention.

Referring next to FIG. 4, a diagram depicting a choked pellet distribution 105 resulting from firing the shotgun shell 10 versus a conventional shotgun shell from the same shotgun, according to the preferred embodiment of the present invention is disclosed. A normal pellet distribution 90 is produced by a shotgun 65 firing a conventional shotgun shell (shown on the top for comparison purposes). The normal pellet distribution 90 provides a pellet spray path with a normal distribution width "nw" 95 and a normal distribution length "nl" 100. Similarly, a choked pellet distribution 105 is produced by a shotgun 65 firing a shotgun shell 10 (shown on the bottom for comparison purposes). The choked pellet distribution 105 provides a pellet spray path with a choked distribution width "cw" 110 and a choked distribution length "cl" 115. As is readily apparent, the shotgun shell 10 produces a choked pellet distribution 105 that is thinner but longer that the normal pellet distribution 90 produced by a conventional shotgun shell. As such, the shotgun shell 10 would be used when the situation requires a choked pellet distribution 105. Examples could be a missed first shot at a target, such as a clay pigeon, now at a greater distance where a conventional shotgun shell 10 would not concentrate the pellets 40 (as shown in FIG. 3) enough to strike the target. This situation could present itself in competition shooting, recreational shooting or hunting.

Figure 5:
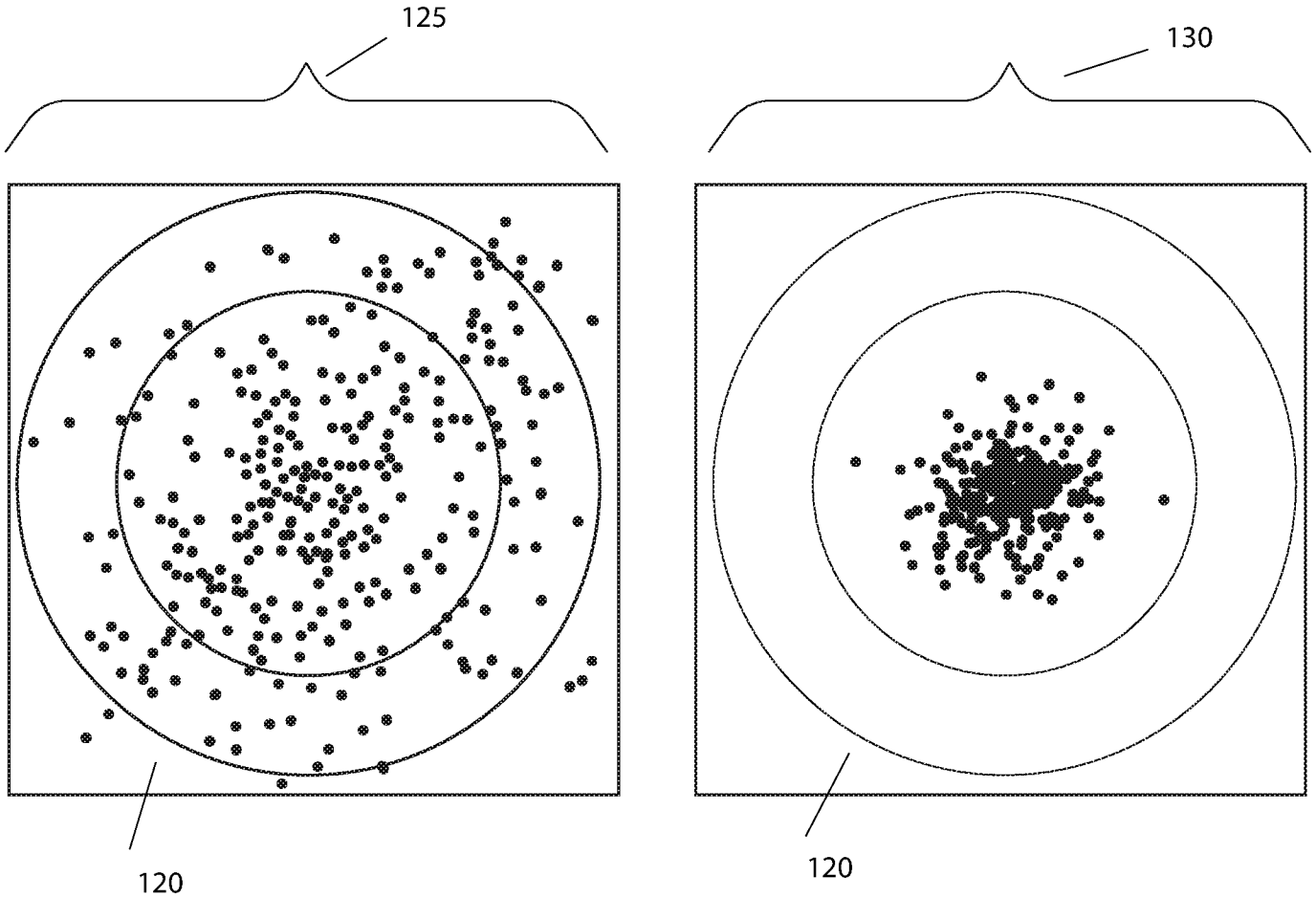

Referring finally to FIG. 5, a diagram depicting the normal pellet distribution 90 resulting from firing the shotgun shell 10 versus a conventional shotgun shell from the same shotgun, according to the preferred embodiment of the present invention is depicted. Two (2) identical targets 120, placed at equal distances from a shotgun 65 (as shown in FIG. 3) depict a dispersed pellet spray pattern 125 (shown on left) from a conventional shotgun shell) and a concentrated pellet spray pattern 130 (shown on the right) from a shotgun shell with choked dispersion pattern 10. As such, it can be easily seen that the concentrated pellet spray pattern 130 provides a more lethal distribution at a closer distance, or equal distribution at a greater distance. These distributions 90, 105 are made from the same shotgun 65 with a single barrel 70 and without modification or replacement of the barrel 70. Additional applications afforded by use of the shotgun shell 10 will be provided herein below.

2. Operation of the Preferred Embodiment

The preferred embodiment of the present invention can be utilized by the common user in a simple and effortless manner with little or no training. It is envisioned that the shotgun shell 10 would be constructed in general accordance with FIG. 1 through FIG. 5. The user would procure the shotgun shell 10 from normal procurement channels while paying attention to configuration details such as gauge, shell length, shell type, dram equivalent, color and others that are variable with conventional shotgun shells 10 as well.

After procurement and prior to utilization, the shotgun shell 10 would be prepared in the following manner: the shotgun shell 10 would be loaded into a shotgun 65 depending on user preference. It is noted that the present invention is envisioned for use with semi-automatic shotguns 65 which allow for rapid cycling of shells during firing. However, it is noted that the present invention could be utilized with all types of shotguns 65 including bolt-action, pump-action, and break action shotguns of both the single- and double-barrel variety. No specific loading sequence is required or is intended to limit the application of the specific invention. Additionally, the specific loading possibilities are virtually endless and beyond the scope of the present application. However, for purposes of illustration, one (1) possible loading scenario is as follows: the shotgun shell 10 would be loaded in an alternating manner with conventional shotgun shells with a conventional shotgun shell as the first shell to be fired. As such, this loading sequence would provide the benefit of a dispersed pellet spray pattern 125 on the first shot with a subsequent concentrated pellet spray pattern 130 if a second shot with a tighter grouping is required. If a second shot is not required, the shotgun shell with choked dispersion pattern 10 could be ejected and saved for re-use during later loadings.

During utilization of the shotgun shell 10, the following procedure would be initiated: the shotgun 65 of any type or style as aforementioned described would be fired in a manner identical to the manner used to fire conventional shotgun shells.

After use of the shotgun shell 10, it is simply ejected (if not automatically done) and the shotgun 65 continues in use in a repeating manner.

Other benefits as provided by the use of the shotgun shell pattern 10 include but are not limited to: eliminating the need for special barrel 70 with a choked internal design, reduced wear on the internal surface of the barrel 70, the delivering of the load (pellets 40) without brake action from a choke, the opportunity to afford a shotgun 65 of the semi-automatic variety a choked option, and a more concentrated power from a shotgun 65 by simply changing the shells used with it.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A shotgun shell, consisting of:

a base having a contained charge and a primer;

a wad;

a plastic case;

a plurality of pellets; and an additional space provided within the plastic case occupied by a first inner lining and a second inner lining;

wherein the first inner lining and the second inner lining restrict an opening diameter through a crimping at a top of the shotgun shell, the opening diameter presents a smaller opening for which the pellets exit through the crimping and thus provides a narrower travel path and a tighter grouping of pellets upon a target;

wherein the primer is directly disposed underneath the charge, the charge is directly disposed underneath the wad, the wad is directly disposed underneath the pellets, and the pellets are directly disposed underneath the top of the shotgun shell and the crimping;

wherein the plastic case is an outermost layer;

wherein the second inner lining is a third inner layer;

wherein the second inner lining is thicker than the plastic case and the first inner lining;

wherein the pellets produce a choked pellet distribution that provides a pellet spray path with a choked distribution width and a choked distribution length;

wherein the plastic case has a blue color or a yellow color to allow for rapid identification of a gauge of the shotgun shell;

wherein the shotgun shell produces the choked pellet distribution that is thinner but longer than a pellet distribution produced by a shotgun shell; and wherein the shotgun shell produces pellets with a tighter grouping with a choked dispersion pattern;

wherein the first inner lining is a next outermost layer;

wherein the opening diameter afforded by the second inner lining produces a pellet travel path which does not allow the pellets to contact an interior surface of the barrel and thus produces a pellet void area which produces a narrow grouping, and wherein the shotgun shell is utilized with a shotgun selected from the group consisting of a bolt action shotgun, a pump-action shotgun, a break action shotgun, a single barrel break action shotgun, or a double barrel break action shotgun.

* * * * *